US011459918B2

(12) United States Patent
Kerss et al.

(10) Patent No.: US 11,459,918 B2
(45) Date of Patent: Oct. 4, 2022

(54) ENGINE ASSEMBLY

(71) Applicant: Perkins Engines Company Limited, Peterborough (GB)

(72) Inventors: Geoffrey Kerss, Peterborough (GB); Owen Else, Peterborough (GB); Prabhu Ramasamy, Peterborough (GB); Menelaos Chatzakis, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 30 days.

(21) Appl. No.: 17/194,864

(22) Filed: Mar. 8, 2021

(65) Prior Publication Data

US 2021/0293163 A1 Sep. 23, 2021

(30) Foreign Application Priority Data

Mar. 20, 2020 (GB) ..... 2004113

(51) Int. Cl.
*F01M 1/04* (2006.01)
*F01M 1/06* (2006.01)
(Continued)

(52) U.S. Cl.
CPC ..... *F01M 1/04* (2013.01); *F01M 1/06* (2013.01); *F01M 11/02* (2013.01); *F01M 13/04* (2013.01); *F02B 39/14* (2013.01); *F02F 7/0043* (2013.01)

(58) Field of Classification Search
CPC . F01M 1/04; F01M 1/06; F01M 11/02; F01M 11/0004; F01M 11/08; F01M 2011/023; F01M 13/04; F01M 2013/005; F01M 13/0011; F02B 39/14; F02B 37/005; F02F 7/0043
See application file for complete search history.

(56) References Cited

U.S. PATENT DOCUMENTS 4,771,745 A 9/1988 Nakamura et al.
4,815,419 A 3/1989 Kitada et al.
(Continued)

FOREIGN PATENT DOCUMENTS

FR 3023591 B1 4/2019
GB 2416812 B 12/2007
(Continued)

OTHER PUBLICATIONS

Great Britain Search Report related to Application No. 2004113.3; dated Nov. 23, 2020.

*Primary Examiner* — Syed O Hasan

(57) ABSTRACT

The present disclosure is directed towards an engine assembly comprising a crankcase, a crankshaft, a lubrication system and fluid guide arrangement. During rotation the crankshaft is configured to drive a crankcase fluid flow in a crankcase chamber. The lubrication system comprises a lubricant drain for a drain fluid flow therethrough extending to a drain aperture at the crankcase chamber. The fluid guide arrangement is located adjacent or in proximity to the drain aperture. The fluid guide arrangement is configured for guiding crankcase fluid flow away from the drain aperture and/or for reducing the pressure of the crankcase fluid flow past the drain aperture, such that drain fluid flows from the lubricant drain.

20 Claims, 5 Drawing Sheets

(51) Int. Cl.

| | |
|---|---|
| ***F01M 11/02*** | (2006.01) |
| ***F02B 39/14*** | (2006.01) |
| ***F02F 7/00*** | (2006.01) |
| ***F01M 13/04*** | (2006.01) |

(56) References Cited

U.S. PATENT DOCUMENTS

| | | | | |
|---|---|---|---|---|
| 5,261,237 | A | 11/1993 | Benson | |
| 6,019,071 | A | 2/2000 | Maciejka, Jr. | |
| 6,457,449 | B1 * | 10/2002 | Troxler | F01M 1/04 123/196 R |
| 10,100,671 | B2 | 10/2018 | Takabatake et al. | |
| 10,287,936 | B2 | 5/2019 | Dunn et al. | |
| 10,385,742 | B2 | 8/2019 | Dunn | |
| 10,669,905 | B2 * | 6/2020 | Nishitani | F02F 1/22 |
| 2016/0312686 | A1 * | 10/2016 | Christian | F01M 13/04 |

FOREIGN PATENT DOCUMENTS

| | | | |
|---|---|---|---|
| JP | S6047821 | A | 3/1985 |
| JP | 2005009434 | A | 1/2005 |
| JP | 2017193977 | A | 10/2017 |
| KR | 101251711 | B1 | 4/2013 |

* cited by examiner

ENGINE ASSEMBLY

CROSS-REFERENCE TO RELATED APPLICATION

This application claims priority under 35 USC § 119 and the Paris Convention to Great Britian Patent Application 2004113.3 filed on Mar. 20, 2020.

TECHNICAL FIELD

This disclosure is directed towards an engine assembly and a method of operating an engine assembly.

BACKGROUND

Machines, including backhoe loaders, excavators, loaders and the like, commonly comprise an engine assembly including an engine, particularly an internal combustion engine, for providing power for driving the machine and operating its components. The engine typically comprises a crankshaft rotating within a crankcase and a lubrication system typically distributes lubricant through the crankshaft and into the crankcase. Engine assemblies also commonly comprise a turbocharger driven by exhaust gases from the engine and for compressing intake gas entering the engine to increase its power output.

The turbocharger may also receive lubricant from the lubrication system and the lubricant may be returned to the crankcase via a lubricant drain. However, high pressure in the crankcase may force lubricant and/or high pressure back into the lubricant drain, such as due to crankshaft windage, and cause a differential pressure in the turbocharger. As a result, seals in the turbocharger may be compromised and lubricant may leak from the turbocharger.

KR101251711B1 discloses a closed crankcase ventilator for preventing oil backdraft expelled into an oil pan and to supply blow-by gas into an intake port of an engine. However, such a ventilator requires an additional device and system components in the engine assembly and also may increase pressure locally around the ventilator.

SUMMARY

The present disclosure therefore provides an engine assembly comprising: a crankcase comprising a crankcase chamber formed at least partially within a crankcase inner surface; a crankshaft rotatably mounted in the crankcase chamber, wherein during rotation the crankshaft is configured to drive a crankcase fluid flow in the crankcase chamber; a lubrication system comprising a lubricant drain for a drain fluid flow therethrough, the lubricant drain extending through the crankcase to a drain aperture at the crankcase chamber; and a fluid guide arrangement mounted to the crankcase, extending into the crankcase chamber from the crankcase inner surface and located adjacent or in proximity to the drain aperture, the fluid guide arrangement being configured for guiding crankcase fluid flow away from the drain aperture and/or for reducing the pressure of the crankcase fluid flow past the drain aperture, such that drain fluid flows from the lubricant drain.

The present disclosure further provides a method of operating the aforementioned engine assembly comprising: rotating the crankshaft and thereby drive the crankcase fluid flow in the crankcase chamber; and operating the lubrication system such that drain fluid flow passes through the lubricant drain to the drain aperture, wherein the fluid guide arrangement guides the crankcase fluid flow away from the drain aperture and/or reduces the pressure of the crankcase fluid flow past the drain aperture, such that the drain fluid flows from the lubricant drain.

BRIEF DESCRIPTION OF THE DRAWINGS

By way of example only, embodiments of apparatuses and methods of the present disclosure are now described with reference to, and as shown in, the accompanying drawings, in which.

DETAILED DESCRIPTION

The present disclosure is generally directed towards an engine assembly in which a fluid guide arrangement is configured to reduce the impact of windage effects upon lubricant draining from a lubricant drain. In particular, the fluid guide arrangement guides fluid flow in the crankcase in order to assist the fluid flow from the lubricant drain. The fluid guide arrangement may guide the drain fluid flow by directing the crankcase fluid flow away from the lubricant drain and/or by inducing a negative pressure in the crankcase fluid flow to draw the drain fluid flow out of the lubricant drain.

Figure 1:
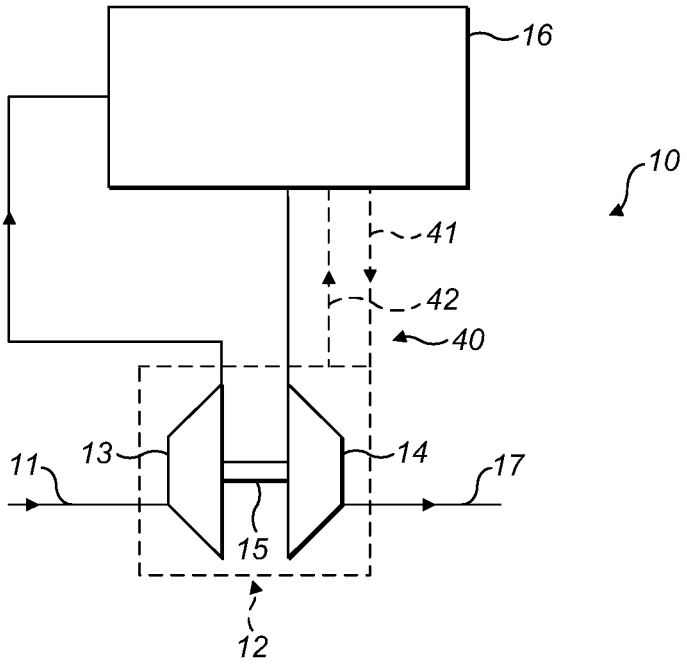
FIG. 1 is a schematic of an engine assembly according to the present disclosure.

FIG. 1 illustrates an exemplary embodiment of an engine assembly 10 according to the present disclosure. The engine assembly 10 may comprise an air intake system 11 for directing intake gas, such as atmospheric air, to a turbocharger 12. The turbocharger 12 may comprise a compressor 13 in fluid communication with the air intake system 11 and the compressor 13 may be arranged to be driven by a turbine 14 via a shaft 15.

The engine assembly 10 further comprises an engine 16, which may be arranged to receive compressed intake gas from the compressor 13. The engine 16 may be in fluid communication with and direct exhaust gas to the turbine 14 for driving the turbine 14. The turbine 14 may be in fluid communication with an exhaust system 17 for directing exhaust gas out of the engine assembly 10 to atmosphere.

Although not illustrated, the engine assembly 10 may comprise a supercharger for further compressing intake gas entering the engine 16, an exhaust gas recirculation system, an aftertreatment system for treating the exhaust gas in the exhaust system 17 to remove pollutants prior to directing the exhaust gas to atmosphere and the like.

Figure 2:
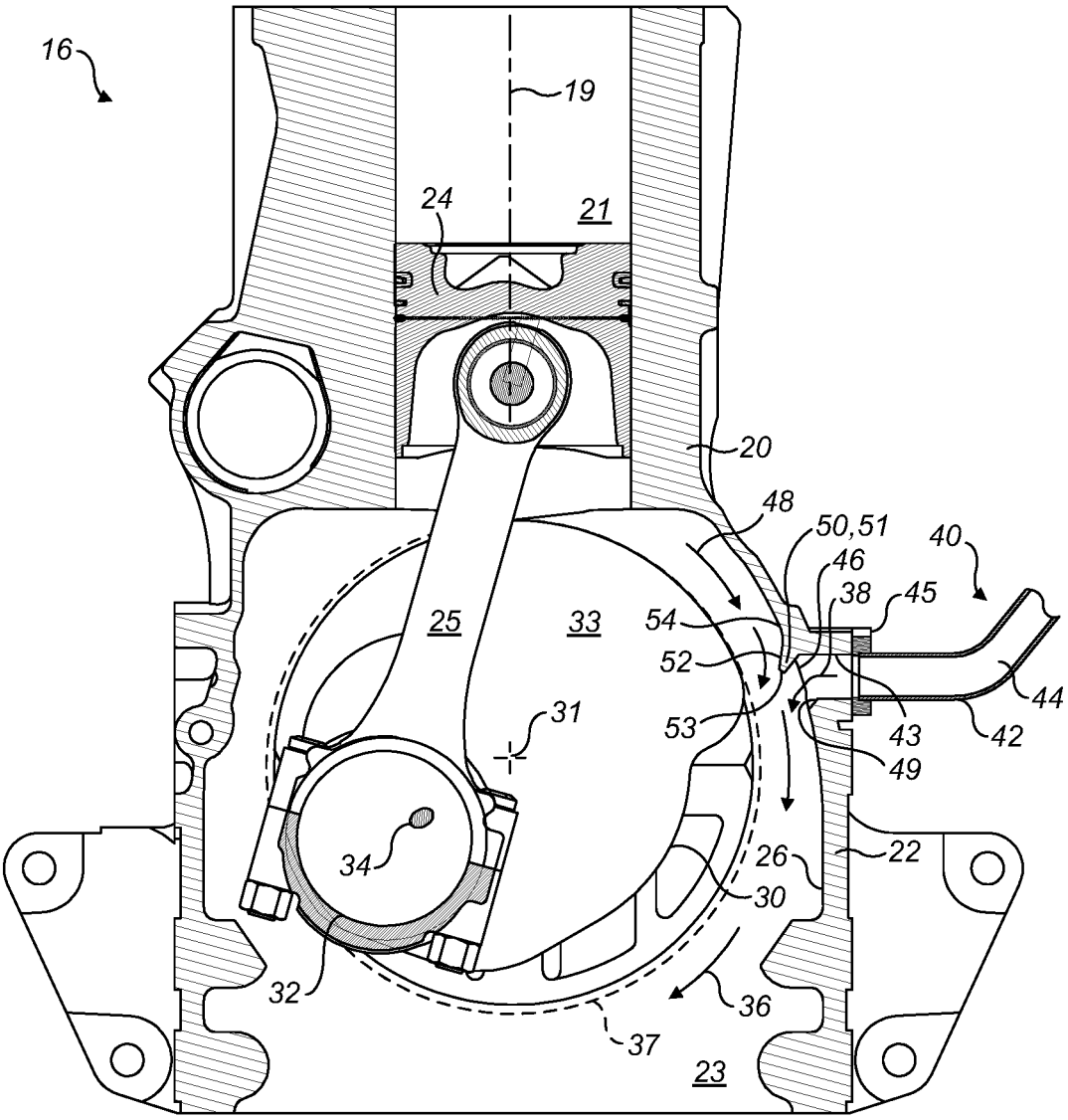
FIG. 2 is a cross-sectional side elevation through a piston of an engine of the engine assembly of FIG. 1.

The engine 16 may be an internal combustion engine, such as a compression-ignition or spark-ignition engine, and an embodiment thereof is illustrated in further detail in FIG. 2. The engine 16 comprises a crankcase 22. The engine 16 may comprise an engine block 20, which may comprise at least one engine cylinder 21 and the crankcase 22. The at least one engine cylinder 21 may comprise at least one bore in the engine block 20 and the crankcase 22 may be integrated within the engine block 20 (for example the crankcase 22 and at least one bore may be formed by a unitary engine block 20). The engine block 20 may be cast comprising the at least one engine cylinder 21 and at least part of the crankcase 22, such as at least an upper portion of the crankcase 22 as illustrated.

The crankcase 22 comprises a crankcase chamber 23 formed at least partially within a crankcase inner surface 26 of the crankcase 22. A lower part of the crankcase 22 (i.e. opposite to the at least one engine cylinder 21) may be open and a lower housing (not shown) may be attached to the crankcase 22 to enclose the crankcase chamber 23 within the engine block 20, crankcase 22 and lower housing. The lower housing may comprise a lubricant sump pan.

The engine 16 may comprise at least one piston 24 reciprocatively mounted within the at least one engine cylinder 21. The at least one piston 24 may be configured to reciprocate along a piston reciprocating axis 19. The engine 16 may comprise at least one intake valve (not shown) for selectively allowing the intake gas, which may be received from the turbocharger 12 and air intake system 11, to enter the at least one engine cylinder 21. The engine 16 may comprise at least one exhaust valve (not shown) for selectively allowing exhaust gas generated by combustion to exit the at least one engine cylinder 21, which may exit the engine assembly 10 via the turbocharger 12 and exhaust system 17.

The engine 16 comprises a crankshaft 30 rotatably mounted in the crankcase 22 and in the crankcase chamber 23. The crankshaft 30 may be rotatable in a crankshaft rotation direction 36 about a crankshaft axis 31. The at least one piston 24 may be mounted to the crankshaft 30 by at least one connecting rod 25 and the crankshaft 30 may be configured, upon rotation about the crankshaft axis 31, to provide a power output from the engine 16.

Fuel, such as diesel, petrol or natural gas, may be selectively provided to the at least one engine cylinder 21 to combust with the intake gas and drive the at least one piston 24, thereby rotating the crankshaft 30 and providing an engine 16 output torque and power.

The crankshaft 30 may be mounted on main bearings (not shown) of the engine 16. The crankshaft 30 may comprise journals 32. The journals 32 may comprise at least one rod journal 32 (as shown in FIG. 2) to which the at least one connecting rod 25 may be rotatably mounted and may comprise at least one main journal (not shown) for rotatably mounting in the main bearings. The at least one rod journal 32 may be offset from the crankshaft axis 31 and the at least one main journal may be aligned with the crankshaft axis 31.

The crankshaft 30 may comprise at least one crankshaft web 33, which may connect and extend between adjacent rod journals 32. The at least one crankshaft web 33 may trace and/or form a crankshaft outer perimeter 37 of the crankshaft 30 during its rotation. As the at least one crankshaft web 33 forms the outermost diameter of the crankshaft 30, the crankshaft outer perimeter 37 may represent the outermost limit of reach of the crankshaft 30 through its entire rotation.

The engine assembly 10 comprises a lubrication system 40 for distributing lubricant, such as oil, therearound. The lubrication system 40 may comprise a lubricant sump or reservoir, which may be in the lower housing in the form of the lubricant sump pan. The lubrication system 40 may comprise at least one pump (not shown) for pumping lubricant around it.

The lubrication system 40 may comprise a crankshaft lubrication system 34 for distributing lubricant to the journals 32 and, as illustrated, the crankshaft lubrication system 34 may comprise at least one duct formed within the crankshaft 30. The at least one pump may direct lubricant through the crankshaft 30 to the journals 32. The lubricant may be ejected from the journals 32 into the crankcase chamber 23 and collected in the lubricant sump.

The lubrication system 40 comprises a lubricant drain 42 for a drain fluid flow 38 therethrough. The drain fluid may comprise lubricant and/or air or gas and the lubricant drain 42 may be for returning the drain fluid to the sump. As illustrated in FIGS. 2 to 5, the lubricant drain 42 may extend through the engine block 20 and crankcase 22 to the crankcase chamber 23 such that drain fluid flowing therethrough may be directed towards the lubricant sump. The lubrication system 40 comprises a drain aperture 46 at the crankcase inner surface 26 and the lubricant drain 42 extends to the drain aperture 46.

The lubricant drain 42 may comprise at least one drain passageway 43 extending through the crankcase 22 and to the drain aperture 46. The at least one drain passageway 43 may comprise at least one bore through, and optionally cast or drilled in, the engine block 20. The lubricant drain 42 may comprise at least one drain tube 44 mounted to the at least one drain passageway 43, such as via a drain flange 45.

The lubrication system 40 may distribute lubricant to the turbocharger 12, as illustrated in FIG. 1. The lubrication system 40 may therefore comprise a turbocharger lubricant inlet arrangement 41 for directing lubricant from the sump to the turbocharger 12. The lubricant drain 42 may be for directing the drain fluid flow 38, comprising at least part of the lubricant that entered the turbocharger 12, from the turbocharger 12 to the crankcase chamber 23 and therefore onto the lubricant sump. The at least one drain tube 44 may extend to the turbocharger 12 from the at least one drain passageway 43.

However, the lubrication system 40 may distribute lubricant to other components of the engine assembly 10 and the lubricant drain 42 may be configured to return drain fluid from any such component. The lubrication system 40 may therefore comprise a plurality of lubricant drains 42 leading from different components.

The crankshaft 30 is configured to drive, and drives during use, a crankcase fluid flow 48 in the crankcase chamber 23. The crankcase fluid may comprise lubricant, such as that sprayed from the lubricant sump and/or crankshaft lubrication system 34 during rotation of the crankshaft 30. The crankcase fluid may comprise a gas, such as the air and/or other exhaust gases or the like within the crankcase chamber 23. The crankshaft 30 may drive such crankcase fluid flow 48 by windage effects. The crankcase fluid flow 48 may be annular around the crankshaft 30 and/or may be between the crankcase 22, particularly the crankcase inner surface 26, and the crankshaft 30. The crankshaft 30 may be configured to drive, and may drive during use, the crankcase fluid flow 48 towards the drain aperture 46. The crankcase fluid flow 48 may extend past the drain aperture 46 and may be in the same direction as the crankshaft rotation direction 36.

The engine 16 comprises a fluid guide arrangement 50 mounted to the crankcase 22 and located adjacent or in proximity to the drain aperture 46. The fluid guide arrangement 50 extends into the crankcase chamber 23 from the crankcase inner surface 26. In particular, the crankcase inner surface 26 may extend around at least about 50% or at least about 60% of the circumference of the crankshaft 30 and the fluid guide arrangement 50 may extend around less than about 50%, less than about 25% or less than about 10% of the circumference of the crankshaft 30. The crankcase inner surface 26 around the crankshaft 30 may be separated from the crankshaft 30 by a greater distance than the fluid guide arrangement 50.

The fluid guide arrangement 50 is configured to guide the crankcase fluid flow 48 as it flows past or in proximity to the drain aperture 46. As a result, the fluid guide arrangement 50 controls the drain fluid flow 38 and/or the drain fluid flows 38 from the lubricant drain 42. The fluid guide arrangement 50 may be configured to change the direction of and/or deflect the crankcase fluid flow 48 from its otherwise substantially circular path around the crankcase chamber 23. The fluid guide arrangement 50 is configured to guide and/or deflect the crankcase fluid flow 48 away from the drain aperture 46. The fluid guide arrangement 50, in addition or alternatively, reduces the pressure of the crankcase fluid flow 48 past the drain aperture 46 (e.g. adjacent to the fluid guide arrangement 50) such that a negative pressure is induced in the crankcase fluid flow 48 relative to the pressure of the drain fluid flow 38 in the lubricant drain 42. FIGS. 2 to 5 illustrate different embodiments of the fluid guide arrangement 50 in accordance with the present disclosure.

The fluid guide arrangement 50 may comprise a first fluid guide wall 51 mounted to the crankcase 22 and located at least partially over and/or upstream of the drain aperture 46, for example as illustrated in FIGS. 2 to 5. The term "upstream" may be along a direction opposite to the crankcase fluid flow 48 and may refer to a feature, such as the first fluid guide wall 51, being located around the crankcase inner surface 26 from the drain aperture 46 in a direction opposite to the crankshaft rotation direction 36 and the crankcase fluid flow 48. Therefore, crankcase fluid flow 48 may be driven past the first fluid guide wall 51 before flowing past the drain aperture 46.

Furthermore, the first fluid guide wall 51 may be located above (for example higher than but not necessarily vertically aligned with) the drain aperture 46 when the engine 16 is in its upright configuration as shown in FIGS. 2 to 5. The first fluid guide wall 51 may guide the crankcase fluid flow 48 as it travels downwardly towards the drain aperture 46. However, if the drain aperture 46 is on the opposing side of the crankcase 22 (for example on the left side in FIG. 2 rather than on the right side as shown) the first fluid guide wall 51 may be located below the drain aperture 46 when the engine 16 is in its upright configuration. Thus in such an arrangement the first fluid guide wall 51 may guide the crankcase fluid flow 48 as it travels upwardly towards the drain aperture 46.

The first fluid guide wall 51 may extend into the crankcase chamber 23 toward the crankshaft axis 31 and/or crankshaft 30 and may comprise a first wall surface 52, which may extend between first wall proximal and distal ends 53, 54. The first wall proximal end 53 may be located proximal to the drain aperture 46 and the first wall distal end 54 may be located distal to the drain aperture 46. The first wall proximal end 53 may be downstream of the first wall distal end 54 and may be downstream of the first wall surface 52. The term "downstream" may refer to a feature being located in a direction along the crankshaft rotation direction 36 and crankcase fluid flow 48 and opposite to the upstream direction. The drain and crankcase fluid flows 38, 48 may mix together downstream of the drain aperture 46.

Figure 3:
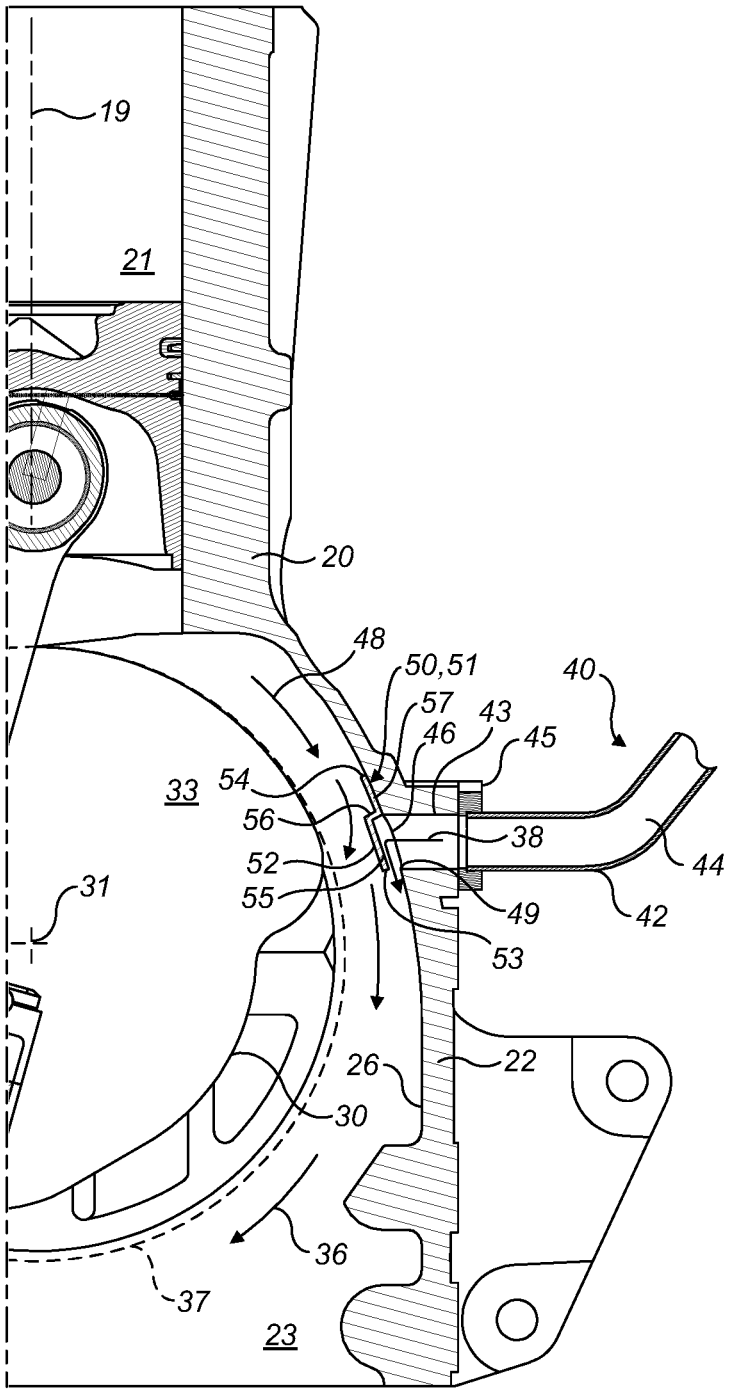
FIG. 3 is a cross-sectional side elevation through a piston of a further embodiment of an engine of the engine assembly of FIG. 1.

As illustrated in FIGS. 2 and 3, the first fluid guide wall 51 is configured to deflect or guide fluid away from the drain aperture 46 and the first wall surface 52 may be configured to direct the crankcase fluid flow 48 away from the drain aperture 46 and/or towards the crankshaft 30 and/or crankshaft axis 31. The first wall surface 52 may be configured to guide or direct crankcase fluid flow 48 past the first wall distal end 54 towards the crankshaft axis 31 and/or crankshaft 30 as it passes by the first wall proximal end 53 such that the fluid is directed away from the drain aperture 46. The first wall surface 52 may be closer to the crankshaft axis 31 at the first wall proximal end 53 than at the first wall distal end 54.

The first wall surface 52 may be substantially concave and may curve and/or extend inwardly towards and/or into the crankcase 22 for guiding the crankcase fluid flow 48 away from the drain aperture 46, for example as illustrated in FIGS. 2 and 3. As illustrated in FIG. 2, the first wall surface 52 may be curved and may curve into the crankcase 22.

Alternatively, as illustrated in FIG. 3, the first wall surface 52 may comprise a plurality of sections 55, 56, 57 arranged concavely and optionally curved. The first fluid guide wall 51 and first wall surface 52 may therefore comprise a plurality of sections 55, 56, 57, each extending in a different direction to an adjacent section 55, 56, 57. A first section 55 may extend substantially parallel to the crankshaft rotation direction 36 from the first wall proximal end 53. A second section 56 may extend from the first section 55 towards the crankcase 22 and may be substantially perpendicular to the crankshaft rotation direction 36. The second section 56 may separate the first section 55 and first wall proximal end 53 from the drain aperture 46. The second section 56 may be mounted directly to the crankcase 22 and form the first wall distal end 54 or, as in FIG. 3, may be mounted to the crankcase 22 by a third section 57, which may extend substantially parallel to the crankshaft rotation direction 36 to the first wall distal end 54.

The first fluid guide wall 51 may extend at least partially over the drain aperture 46 and/or the first wall proximal end 53 may overhang the drain aperture 46, for example as illustrated in FIGS. 2 and 3. In particular, the first fluid guide wall 51 may extend, in the crankshaft rotation direction 36 and downstream direction, at least partially across the drain aperture 46. Therefore, drain fluid flow 38 exiting the drain aperture 46 may be at least partially directed onto the first fluid guide wall 51. The first fluid guide wall 51 may be configured to change the direction of the drain fluid flow 38 exiting the lubricant drain 42 and direct the drain fluid flow 38 into the crankcase fluid flow 48 downstream of the drain aperture 46. The first wall proximal end 53 may extend across at least about 25%, at least about 50% or all of the diameter of the drain aperture 46, the latter being illustrated in FIG. 3. A lower edge 49 of the drain aperture 46 may be chamfered, for example as shown in FIG. 2, to assist in directing fluid in the downstream direction.

The fluid guide arrangement 50 reduces the pressure of the crankcase fluid flow 48 past the drain aperture 46. The fluid guide arrangement 50 may be configured to induce a negative pressure in the crankcase chamber 23 adjacent to the drain aperture 46 relative to the pressure in the lubricant drain 42. The fluid guide arrangement 50 may form a differential pressure between the crankcase fluid flow 48 in the crankcase 22 and the drain fluid flow 38 in the lubricant drain 42. The fluid guide arrangement 50 may be configured to draw the drain fluid flow 38 out of the lubricant drain 42 and into the crankcase chamber 23 for mixing with the crankcase fluid flow 48. In particular, the fluid guide arrangement 50 may be configured to induce the Venturi effect adjacent to the drain aperture 46 to form such a negative pressure.

The fluid guide arrangement 50 may therefore form a constriction between the fluid guide arrangement 50 and crankshaft 30 for the crankcase fluid flow 48 to pass through. The constriction may comprise a convergent section and/or a throat and a divergent section downstream of the convergent section and/or throat. The fluid guide arrangement 50 may form the throat at its minimum distance from the crankshaft 30, for example where the first fluid guide wall 51 and first wall surface 52 are closest to the crankshaft 30 and crankshaft outer perimeter 37.

As illustrated in FIGS. 2 and 3 the first fluid guide wall 51 may form the convergent section and/or throat and the divergent section may be formed downstream of the first wall proximal end 53. The first wall surface 52 may form the convergent section and throat, such as by being substantially concave, and the throat may extend upstream of the first wall proximal end 53. The divergent section may be formed between the first wall proximal end 53 and drain aperture 46. The first fluid guide wall 51, and particularly the first wall surface 52 thereof, may be closer to the crankshaft 30 and/or crankshaft axis 31 than a portion of the crankcase inner surface 26 adjacent to and downstream of the drain aperture 46. As a result, the pressure of the crankcase fluid flow 48 may increase as it passes over the first wall surface 52 and may decrease downstream of the first wall proximal end 53 and/or first fluid guide wall 51. Thus the crankcase fluid flow 48 adjacent to the drain aperture 46 may have a negative or lower pressure relative to that of the drain fluid flow 38 in the lubricant drain 42 such that the drain fluid flow 38 is drawn out of the lubricant drain 42 by the crankcase fluid flow 48.

Figure 4:
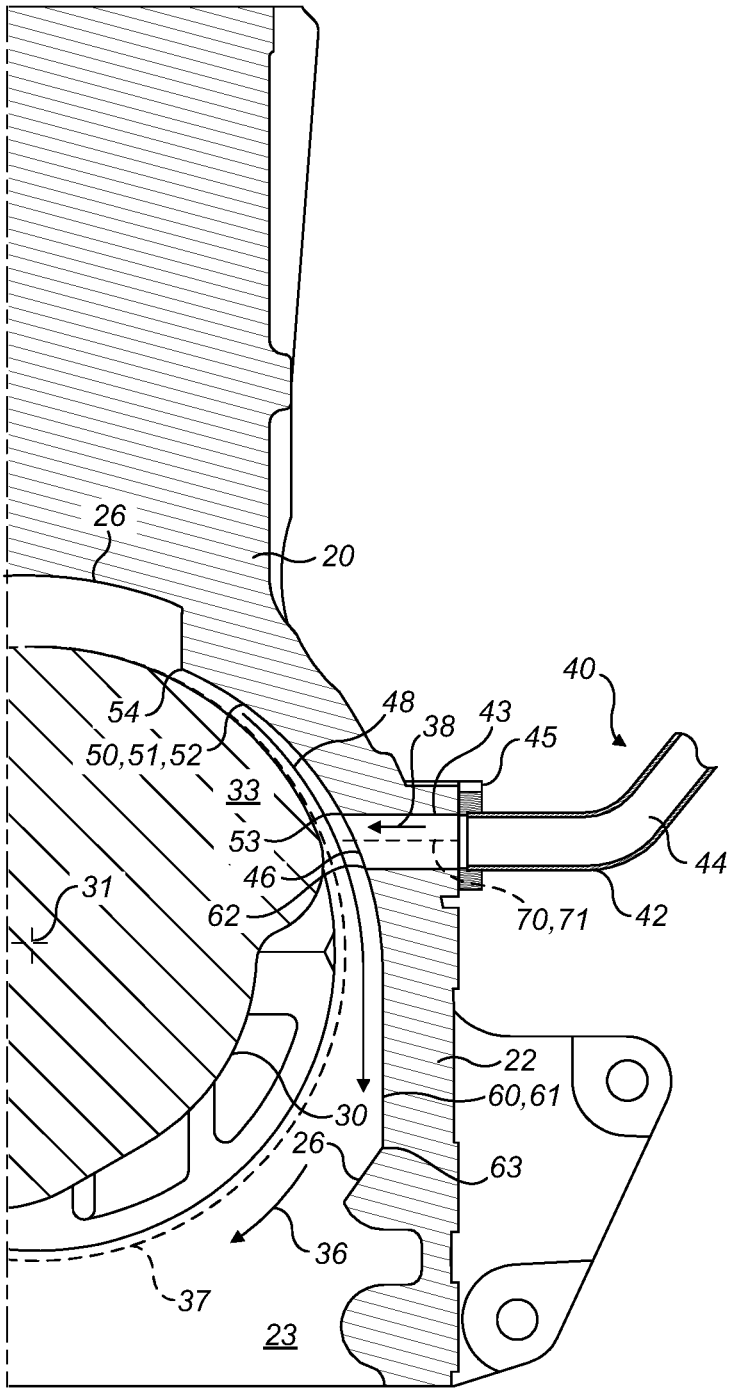
FIG. 4 is a cross-sectional side elevation through a crankshaft web of a further embodiment of an engine of the engine of the engine assembly of FIG. 1.
Figure 5:
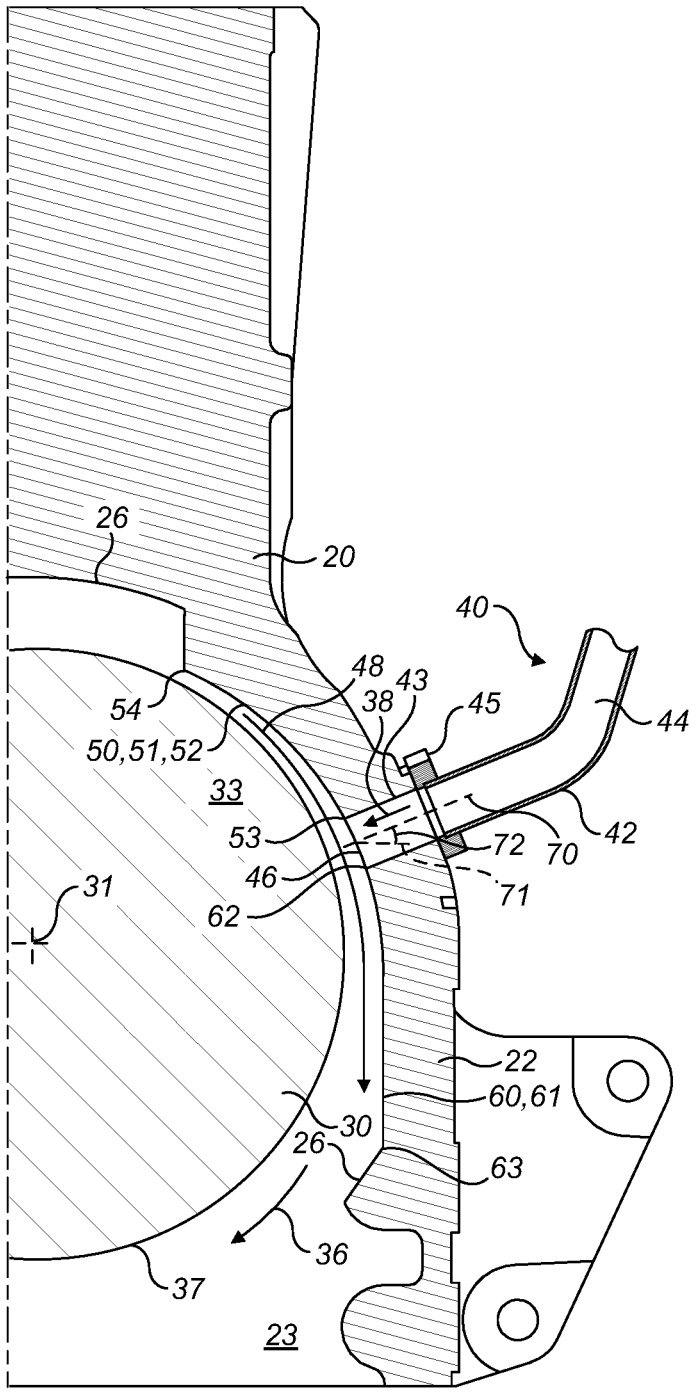
FIG. 5 is a cross-sectional side elevation through a crankshaft web of a further embodiment of an engine of the engine of the engine assembly of FIG. 1

Alternatively, as illustrated in FIGS. 4 and 5, the fluid guide arrangement 50 may comprise a divergent section and the drain aperture 46 may be located in the divergent section. In such an arrangement the first fluid guide wall 51 may not substantially deflect crankcase fluid flow 48 away from the drain aperture 46. The first fluid guide wall 51 may form the convergent section, throat and at least part of the divergent section. The first fluid guide wall 51 may be closest to the crankshaft 30, crankshaft axis 31 and/or crankshaft outer perimeter 37 at its first wall distal end 54 and the first wall distal end 54 may form the convergent section and throat. The first wall surface 52 may extend from the first wall distal end 54 to the first wall proximal end 53 and the separation between the first wall surface 52 and crankshaft 30, crankshaft axis 31 and/or crankshaft outer perimeter 37 may increase, for example continuously, from the first wall distal end 54 to the first wall proximal end 53. Thus the first wall surface 52 may form at least part of the divergent section. The first wall surface 52 may be concave and may extend inwardly into the crankcase 22.

At the first wall proximal end 53 the separation between the first fluid guide wall 51 and crankshaft outer perimeter 37 may be in the range of about 1 mm to about 10 mm or of about 2 mm to 7 mm. At the first wall distal end 54 the separation between the first fluid guide wall 51 and crankshaft outer perimeter 37 may be in the range of about 0.1 mm to about 1 mm.

The fluid guide arrangement 50 may comprise a second fluid guide wall 60 extending downstream from the drain aperture 46. The second fluid guide wall 60 may comprise a second wall surface 61 and may extend from a second wall proximal end 62 adjacent to the drain aperture 46 to a second wall distal end 63 distal to the drain aperture 46. The second fluid guide wall 60 may be closest to the crankshaft 30, crankshaft axis 31 and/or crankshaft outer perimeter 37 at its second wall proximal end 62. The separation between the second wall surface 61 and crankshaft 30, crankshaft axis 31 and/or crankshaft outer perimeter 37 may increase, for example continuously, from the second wall proximal end 62 to the second wall distal end 63. Thus the second wall surface 61 may form at least part of the divergent section. The second wall surface 61 may be concave and may extend inwardly into the crankcase 22.

The arrangement of FIGS. 4 and 5 as described above is particularly suitable for inducing a negative pressure in the crankcase fluid flow 48 compared to that of the drain fluid flow 38. This may particularly result from the crankcase fluid flow 48 between the fluid guide arrangement 50 and crankshaft 30 having a lower pressure and higher velocity than elsewhere between the crankshaft 30 and crankcase inner surface 26. The pressure of the crankcase fluid flow 48 will be lowest where the fluid guide arrangement 50 is closest to the crankshaft 30 at the throat, which may be at the first wall distal end 54 as in FIGS. 4 and 5. Thus the drain aperture 46 may be located at the throat. However, the drain aperture 46 may be located at a distance from the throat, such as in the divergent portion as illustrated, in order to allow for natural drainage from the drain aperture 46.

As in FIG. 4 a centreline 70 of the at least one drain passageway 43 may extend substantially horizontally along a horizontal axis 71. As will be appreciated, the horizontal axis 71 may not always be horizontal as the engine 16 changes its orientation during use, such as when the machine it is located in travels over undulations in terrain. However, the horizontal axis 71 may be substantially horizontal when the engine 16 is in its illustrated upright configuration. The horizontal axis 71 may extend in a direction substantially perpendicular to the crankshaft axis 31 and perpendicular to the piston reciprocating axis 19, although the horizontal, crankshaft and/or piston reciprocating axes 71, 31, 19 may not intersect.

However, as illustrated in FIG. 5 the centreline 70 of the at least one drain passageway 43 may extend at an acute angle 72 to the horizontal axis 71. Such an arrangement may assist with the draining of the drain fluid flow 38 by gravity. The acute angle 72 may be approximately 90 degrees such that the centreline 70 of the at least one drain passageway 43 extends vertically. The acute angle 72 may be at least about 10 degrees, at least about 25 degrees, at least about 45 degrees and/or up to about 90 degrees.

As illustrated in FIGS. 2 and 3, the drain aperture 46 and fluid guide arrangement 50 may be aligned with a rod journal 32 along the crankshaft 30, such as when the fluid guide arrangement 50 is configured to deflect crankcase fluid flow 48 away from the drain aperture 46. Thus in such an arrangement the fluid guide arrangement 50 may deflect crankcase fluid flow 48 between itself and the rod journal 32.

However, as illustrated in FIGS. 4 and 5, the drain aperture 46 and fluid guide arrangement 50 may be aligned with a crankshaft web 33 along the crankshaft 30. Such an arrangement may be suitable when the fluid guide arrangement 50 is configured to induce a negative pressure in the crankcase fluid flow 48 because the spacing between the fluid guide arrangement 50 and crankshaft 30 is smaller. As in FIG. 4 the crankshaft web 33 may comprise a counterweight and may not be circular. However, as illustrated in FIG. 5, the crankshaft web 33 may be substantially round and therefore a negative pressure may be maintained substantially continuously between the crankshaft 30 and fluid guide arrangement 50.

In FIGS. 2 to 5 the fluid guide arrangement 50, first fluid guide wall 51 and/or second fluid guide wall 60 are located adjacent to the drain aperture 46 and there is substantially no separation therebetween. However, although not illustrated, the fluid guide arrangement 50, first fluid guide wall 51 and/or second fluid guide wall 60 may be located in proximity to and may be separated from the drain aperture 46. For example, a portion of the crankcase 22 and crankcase inner surface 26 may extend between the drain aperture 46 and fluid guide arrangement 50, first fluid guide wall 51 and/or second fluid guide wall 60. The separation may be within a range that still ensures that the fluid guide arrangement 50, first fluid guide wall 51 and/or second fluid guide wall 60 are sufficiently close that they control the crankcase fluid flow 48 past the drain aperture 46 and thereby control the drain fluid flow 38 from the lubricant drain 42. Thus the fluid guide arrangement 50, first fluid guide wall 51 and/or second fluid guide wall 60 may be less than about 50 mm or less than about 25 mm away from the drain aperture 46.

The fluid guide arrangement 50, such as the first and/or second fluid guide walls 51, 60, may be formed integrally with the crankcase 22 and/or engine block 20 as illustrated in FIGS. 2, 4 and 5. As in FIG. 2, the first fluid guide wall 51 may comprise a lip or protrusion extending into the crankcase chamber 23. In particular, the fluid guide arrangement 50 may be cast with the crankcase 22 and/or engine block 20 and/or the fluid guide arrangement 50 may be part of a unitary structure including the crankcase 22 and/or engine block 20. Alternatively, as illustrated in FIG. 3, the fluid guide arrangement 50, such as the first and/or second fluid guide walls 51, 60, may be formed separately to the crankcase 22 and/or engine block 20 and subsequently attached thereto. For example, the fluid guide arrangement 50 may comprise at least one plate or member and may be welded or otherwise joined to the crankcase 22 and/or engine block 20. As a result, the fluid guide arrangement 50 may be retrofitted to an existing engine 16 that does not already comprise such a fluid guide arrangement 50.

The fluid guide arrangement 50 may extend along a width (not shown in FIGS. 2 to 5) along the crankcase 22 and along the crankshaft axis 31. The width may be at least the maximum diameter of the drain aperture 46 and/or crankshaft web 33. The fluid guide arrangement 50 may extend by at least half a diameter of the drain aperture 46 on either side of the drain aperture 46. The width of the fluid guide arrangement 50 may be at least twice the diameter of the drain aperture 46.

The fluid guide arrangement 50 may be configured to avoid impacting the flow under gravity of lubricant from the drain aperture 46. If, as discussed above, the drain aperture 46 is on the opposing side of the crankcase 22 and the first fluid guide wall 51 is located below the drain aperture 46 when the engine 16 is in its upright configuration, the fluid guide arrangement 50 may be arranged in a similar manner to that shown in FIGS. 4 and 5. As a result, the fluid guide arrangement 50 does not impact the flow of lubricant from the drain aperture 46 under gravity.

INDUSTRIAL APPLICABILITY

Rotation of the crankshaft 30 may result in windage effects, which may be in the form of turbulence in the air around the crankshaft 30 and the lubricant being thrown about the crankshaft 30 within the crankcase 22. Such windage effects may be caused by air resistance or friction around the crankshaft 30. In prior art systems the windage effects may direct the crankcase fluid flow 48 towards the drain aperture 46. The turbulence may cause a higher pressure adjacent to the drain aperture 46 such that, in prior art systems, high pressure air and lubricant is forced back up into the lubricant drain 42. As a result, in such prior art systems a pressure differential may be created in the turbocharger 12, which may compromise the seals therein such that lubricant may leak therefrom.

However, the fluid guide arrangement 50 of the present disclosure controls, adapts or adjusts crankcase fluid flow 48 past the drain aperture 46 and therefore controls the drain fluid flow 38 from the lubricant drain 42, such as by preventing the crankcase fluid flow 48 from backing up through the lubricant drain 42 and/or by drawing the drain fluid flow 38 therefrom. The fluid guide arrangement 50 may control the crankcase 22 and drain fluid flow 48, 38 by directing the crankcase fluid flow 48 away from the drain aperture 46 and/or by inducing a negative pressure adjacent to the drain aperture 46 in order to draw the drain fluid flow 38 from the lubricant drain 42 and into the crankcase fluid flow 48. Thus the fluid guide arrangement 50 may reduce windage effects at the drain aperture 46 such that higher pressure air and lubricant are substantially not forced into the lubricant drain 42.

What is claimed is:

1. An engine assembly comprising: a crankcase comprising a crankcase chamber formed at least partially within a crankcase inner surface; a crankshaft rotatably mounted in the crankcase chamber, wherein during rotation the crankshaft is configured to drive a crankcase fluid flow in the crankcase chamber; a lubrication system comprising a lubricant drain for a drain fluid flow therethrough, the lubricant drain extending through the crankcase to a drain aperture at the crankcase chamber; and a turbocharger, wherein the lubrication system distributes lubricant to the turbocharger and the lubricant drain is configured to direct lubricant from the turbocharger to the crankcase chamber; a fluid guide arrangement mounted to the crankcase, extending into the crankcase chamber from the crankcase inner surface and located adjacent or in proximity to the drain aperture, the fluid guide arrangement being configured for guiding crankcase fluid flow away from the drain aperture and for reducing the pressure of the crankcase fluid flow past the drain aperture, such that drain fluid flows from the lubricant drain; the fluid guide arrangement includes a first fluid guide wall located at least partially over and extending upstream from the drain aperture, the first fluid guide wall extends towards the crankshaft and comprises a first wall surface being concave and configured to direct the crankcase fluid flow away from the drain aperture and towards the crankshaft.

2. The engine assembly as claimed in claim 1, wherein the first fluid guide wall extends at least partially over the drain aperture such that drain fluid flow exiting the drain aperture is at least partially directed onto the first fluid guide wall and the first fluid guide wall is configured to change the direction of the drain fluid flow exiting the lubricant drain and direct the drain fluid flow into the crankcase fluid flow.

3. The engine assembly as claimed in claim 1 wherein the fluid guide arrangement is configured to guide crankcase fluid flow past the drain aperture and induce a negative pressure in the crankcase chamber adjacent to the drain aperture relative to a pressure in the lubricant drain.

4. The engine assembly as claimed in claim 3 wherein the fluid guide arrangement is arranged to form a constriction between the fluid guide arrangement and the crankshaft for reducing the pressure of the crankcase fluid flow passing therebetween.

5. The engine assembly as claimed in claim 4 wherein the fluid guide arrangement comprises a throat and/or convergent section upstream of the drain aperture and/or comprises a divergent section, the drain aperture being located in or upstream of the divergent section.

6. The engine assembly as claimed in claim 1, wherein the first fluid guide wall is closer to the crankshaft than a portion of the crankcase downstream of the drain aperture.

7. The engine assembly as claimed in claim 1, wherein the first fluid guide wall extends from a first wall proximal end adjacent the drain aperture to a first wall distal end and the separation between the first fluid guide wall and crankshaft increases from the first wall proximal end to the first wall distal end.

8. The engine assembly as claimed in claim 1, wherein the first fluid guide wall extends from a first wall proximal end adjacent the drain aperture to a first wall distal end and the separation between the first fluid guide wall and crankshaft continuously increases from the first wall distal end to the first wall proximal end.

9. The engine assembly as claimed in claim 1 wherein the fluid guide arrangement comprises a second fluid guide wall extending from a second wall proximal end adjacent the drain aperture to a second wall distal end and the separation between the second fluid guide wall and crankshaft continuously increases from the first second wall proximal end to the first second wall distal end.

10. The engine assembly as claimed in claim 1 wherein the fluid guide arrangement is formed integrally with the crankcase and/or comprises at least one plate attached to the crankcase.

11. A method of operating the engine assembly comprising: a crankcase comprising a crankcase chamber formed at least partially within a crankcase inner surface of the crankcase; a crankshaft rotatably mounted in the crankcase chamber, wherein during rotation the crankshaft is configured to drive a crankcase fluid flow in the crankcase chamber; a lubrication system comprising a lubricant drain for a drain fluid flow therethrough, the lubricant drain extending through the crankcase to a drain aperture at the crankcase chamber; and a turbocharger, wherein the lubrication system distributes lubricant to the turbocharger and the lubricant drain is configured to direct lubricant from the turbocharger to the crankcase chamber; a fluid guide arrangement mounted to the crankcase, extending into the crankcase chamber from the crankcase inner surface and located adjacent or in proximity to the drain aperture, the fluid guide arrangement being configured for guiding crankcase fluid flow away from the drain aperture and/or for reducing the pressure of the crankcase fluid flow past the drain aperture, such that drain fluid flows from the lubricant drain, wherein the method comprises: rotating the crankshaft and thereby drive the crankcase fluid flow in the crankcase chamber; and operating the lubrication system such that drain fluid flow passes through the lubricant drain to the drain aperture, wherein the fluid guide arrangement guides the crankcase fluid flow away from the drain aperture and/or reduces the pressure of the crankcase fluid flow past the drain aperture, such that the drain fluid flows from the lubricant drain; the fluid guide arrangement includes a first fluid guide wall located at least partially over and extending upstream from the drain aperture, the first fluid guide wall extends towards the crankshaft and comprises a first wall surface being concave and configured to direct the crankcase fluid flow away from the drain aperture and towards the crankshaft.

12. An engine assembly comprising: a crankcase comprising a crankcase chamber formed at least partially within a crankcase inner surface; a crankshaft rotatably mounted in the crankcase chamber, wherein during rotation the crankshaft is configured to drive a crankcase fluid flow in the crankcase chamber; a lubrication system comprising a lubricant drain for a drain fluid flow therethrough, the lubricant drain extending through the crankcase to a drain aperture at the crankcase chamber; and a fluid guide arrangement mounted to the crankcase, extending into the crankcase chamber from the crankcase inner surface and located adjacent or in proximity to the drain aperture, the fluid guide arrangement being configured for guiding crankcase fluid flow away from the drain aperture and for reducing the pressure of the crankcase fluid flow past the drain aperture, such that drain fluid flows from the lubricant drain; wherein the fluid guide arrangement includes a first fluid guide wall and a second fluid guide wall; the first fluid guide wall being mounted to the crankcase in the crankcase chamber and located at least partially over and extending upstream from the drain aperture and further extends from a first wall proximal end adjacent the drain aperture to a first wall distal end and the separation between the first fluid guide wall and crankshaft continuously increases from the first wall distal end to the first wall proximal end; and the second fluid guide wall extending from a second wall proximal end adjacent the drain aperture to a second wall distal end and the separation between the second fluid guide wall and crankshaft continuously increases from the second wall proximal end to the second wall distal end.

13. The engine assembly as claimed in claim 12, wherein the first fluid guide wall extends into the crankcase chamber towards the crankshaft and comprises a first wall surface configured to direct the crankcase fluid flow away from the drain aperture and towards the crankshaft.

14. The engine assembly as claimed in claim 12, wherein the first wall surface is concave and extends inwardly towards and into the crankcase for directing the crankcase fluid flow away from the drain aperture and towards the crankshaft.

15. The engine assembly according to claim 12, further comprising a turbocharger, wherein the lubrication system distributes lubricant to the turbocharger and the lubricant drain is configured to direct lubricant from the turbocharger to the crankcase chamber.

16. The engine assembly as claimed in claim 12, wherein the fluid guide arrangement is configured to guide crankcase fluid flow past the drain aperture and induce a negative pressure in the crankcase chamber adjacent to the drain aperture relative to a pressure in the lubricant drain.

17. The engine assembly as claimed in claim 16, wherein the fluid guide arrangement is arranged to form a constriction between the fluid guide arrangement and the crankshaft for reducing the pressure of the crankcase fluid flow passing therebetween.

18. The engine assembly as claimed in claim 16, wherein the fluid guide arrangement comprises a throat and convergent section upstream of the drain aperture and comprises a divergent section, the drain aperture being located in or upstream of the divergent section.

19. The engine assembly as claimed in claim 12 wherein the first fluid guide wall extends from a first wall proximal end adjacent the drain aperture to a first wall distal end and the separation between the first fluid guide wall and crankshaft increases from the first wall proximal end to the first wall distal end.

20. The engine assembly as claimed in claim 12, wherein the fluid guide arrangement is formed integrally with the crankcase and/or comprises at least one plate attached to the crankcase.

* * * * *